United States Patent [19]

Nakano et al.

[11] 4,389,541

[45] Jun. 21, 1983

[54] VEHICLE-MOUNTED MESSAGE APPARATUS

[75] Inventors: Osamu Nakano; Kunihiro Sowa, both of Okazaki, Japan

[73] Assignee: Nippon Soken, Inc., Nishio, Japan

[21] Appl. No.: 254,496

[22] Filed: Apr. 15, 1981

[30] Foreign Application Priority Data

Apr. 18, 1980 [JP] Japan ..... 55-52186

[51] Int. Cl.[3] ..... G10L 1/00

[52] U.S. Cl. ..... 179/1 SM; 179/1 VE

[58] Field of Search ..... 179/1 SM, 1 SG, 1 VL, 179/1 VE; 360/8; 340/63, 64, 88, 148

[56] References Cited

U.S. PATENT DOCUMENTS 4,318,188 3/1982 Hoffmann ..... 179/1 SM 4,346,364 8/1982 Takagi et al. ..... 179/1 SM

*Primary Examiner*—Emanuel S. Kemeny

*Attorney, Agent, or Firm*—Cushman, Darby & Cushman

[57] ABSTRACT

A vehicle-mounted message apparatus comprising a device for converting a voice into an electrical signal, storing it in a memory, and reproducing and confirming automatically the stored data after being stored, a device for reproducing the stored data into a voice when required, and a device for erasing the stored data after reproducing the same for confirmation in response to a starting switch.

14 Claims, 4 Drawing Figures

VEHICLE-MOUNTED MESSAGE APPARATUS

BACKGROUND OF THE INVENTION

The present invention relates to a vehicle-mounted message apparatus which records a simple message by voice and automatically reproduces it for notification.

In the case where a single motor vehicle for business or a company-owned passenger car is used by a plurality of persons, a driver may want to leave a message including instructions on fuel supply, car cleaning or transfer to another use or place to the next driver or vehicle administrator when leaving the vehicle. If such a message is left in the form of written memo, it may go astray or may be overlooked.

SUMMARY OF THE INVENTION

Accordingly, it is an object of the present invention to provide a vehicle-mounted message apparatus which records a message through a microphone and reproduces it by speaker, thus informing the next driver of instructions as required.

DESCRIPTION OF THE PREFERRED EMBODIMENTS

Figure 1:
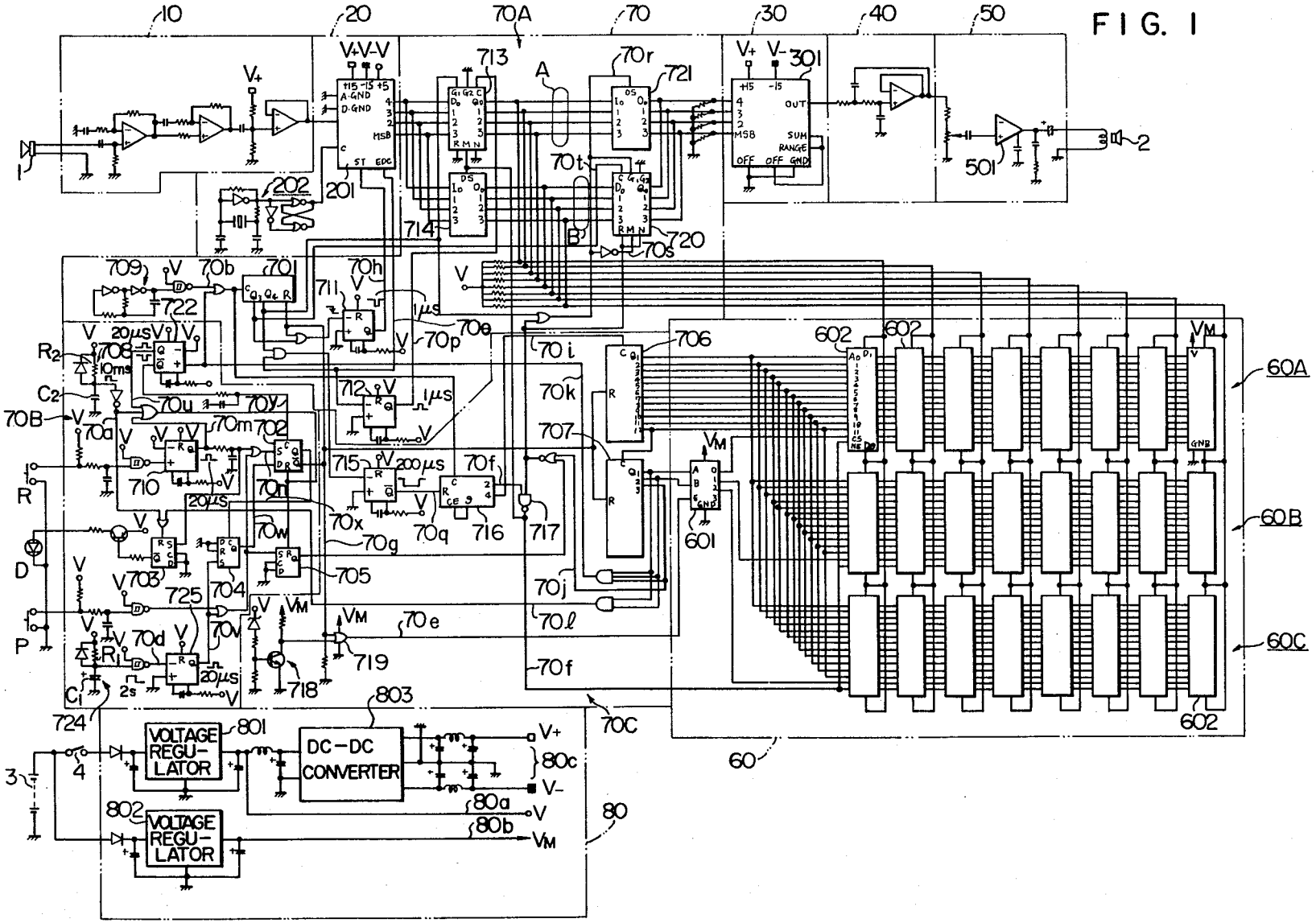
FIG. 1 is a diagram showing an electrical circuit of an embodiment according to the present invention.

The present invention will be described with reference to the accompanying drawings. In the electrical wiring diagram of FIG. 1 showing a general configuration of the apparatus of the invention, reference numeral 1 shows a recording microphone for converting a voice into an electrical signal. Numeral 2 shows a reproduction speaker for converting an electrical signal into a voice. As an alternative, the microphone 1 and the speaker 2 may be integrated in the form of a single dynamic speaker as used in a compact radio communication equipment.

Numeral 3 shows a DC battery mounted in a vehicle, and numeral 4 a key switch provided at accessory position or ignition position.

Reference characters R and P show operating switches, of which character R shows a control switch for issuing a recording command and character P shows a control switch for reproduction in order to confirm the recording command. Character D shows a display unit which is lit for a period of time during which the recording is available after operation of the switch R. The display unit D includes a light-emitting diode. The recording switch R and the display unit D may be conveniently formed integrally with the microphone 1 to facilitate manual operation.

Numeral 10 shows an amplifier circuit for amplifying a weak voice electrical signal converted through the microphone 1, and numeral 20 shows an analog-digital converter for repetitively converting at high speed the amplified voice electrical signal (voltage signal) into a 4-bit digital signal easy to be memorized. This converter circuit 20 comprises the A/D converter MN5123 of sequential comparison type marketed by Micronetwork as designed by numeral 201 and a clock signal generator circuit 202 for generating a clock signal of 2 MHz for actuating the converter 201. The digitized voice data are applied at the rate of 8 bits at a time to a semiconductor memory unit 60 in predetermined cycles through a control circuit 70. The voice data are also read out from the memory 60 at the rate of 8 bits at a time in predetermined cycles and applied to the digital-analog converter 30. This converter circuit 30 is configured of the D/A Converter MN3014 (designated by 301) of ladder type marketed by Micronetwork, which converts a digital signal representing a voice into a voltage signal. Numeral 40 shows a low-pass filter for cutting off high frequencies, which is adjusted at the cut-off frequency of 1.8 KHz. Numeral 50 shows a reproduction amplifier which by use of an integrated amplifier element (such as LM380 of National Semiconductor) amplifies a voice signal and announces it as a voice through the speaker 2.

The semiconductor memory unit 60 includes a decoder 601 (such as TC4556 of Toshiba) and a plurality of CMOS random access memories (such as HM6147 of Hitachi, Ltd.). Random access memory groups 60A, 60B and 60C each including eight random access memories corresponding to the 8 bits subjected to A/D or D/A conversion respectively are arranged in juxtaposition under the control of a decoder 601, so that a total of 4096 multiplied by 3 addresses are set in the memory unit 60.

The control circuit 70 is for controlling the operations of the A/D converter 20, the D/A converter 30, the data storage in the memory unit 60 and the reading thereof from the memory unit 60 in response to the start of power supply by the closing of the key switch 4 and the control switches R and P, thus causing the apparatus to effect the recording, reproduction or erasure selectively. This control circuit 70 is divided by function into a timing circuit 70A for controlling the timing of recording, reproducing and erasing operations, a condition or mode determining circuit 70B for determining the operating mode of the recording, reproduction or erasure, and a memory control circuit 70C for designating an address of the semiconductor memory unit 60 and issuing a command for change-over between storage and reading. The detailed operation of the circuits 70A, 70B and 70C will be described with reference to the operation of the apparatus as a whole later.

Numeral 80 shows a power supply circuit comprising a voltage regulator 801 (SI-3554M of Sanken) for generating a constant voltage of 80*a* (V) in response to the closing of the key switch 4, a voltage regulator 802 (MC7805 of Motorola) for generating a constant voltage of 80*b* (VM) for the backup of the memory unit 60 regardless of whwether or not the key switch 4 is closed, and a DC-DC converter 803 (CX255-5 of Tokyo Radio Equipments) for generating positive and negative voltages of 80*c* ($V_+$, $V_-$) for actuating the A/D converter 201 and the D/A converter 301.

Figure 2:
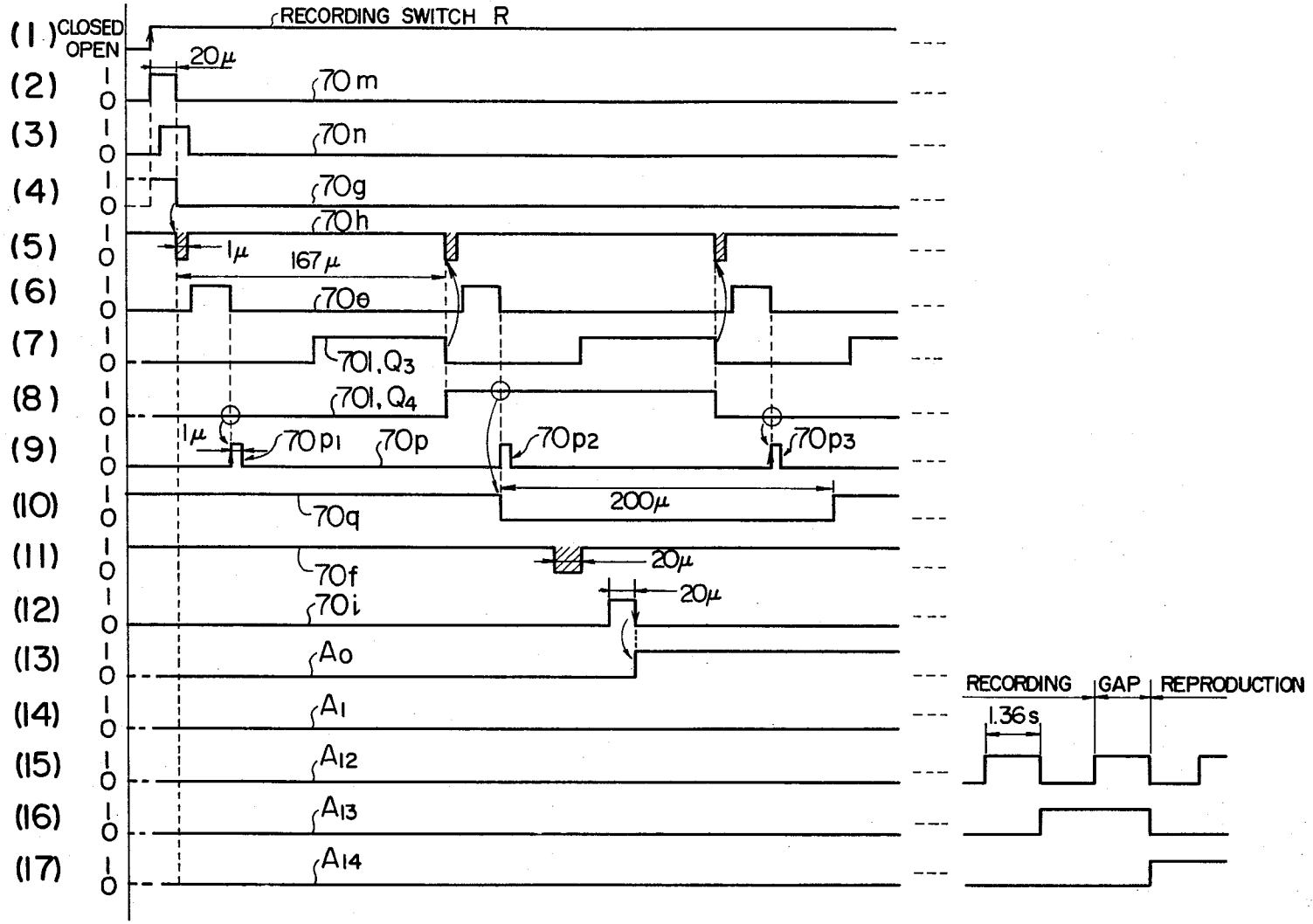
FIGS. 2, 3 and 4 are timing charts showing the operations of recording and reproduction of the apparatus shown in FIG. 1 and the reproduction and erasure at the time of closing a key switch thereof respectively.
Figure 3:
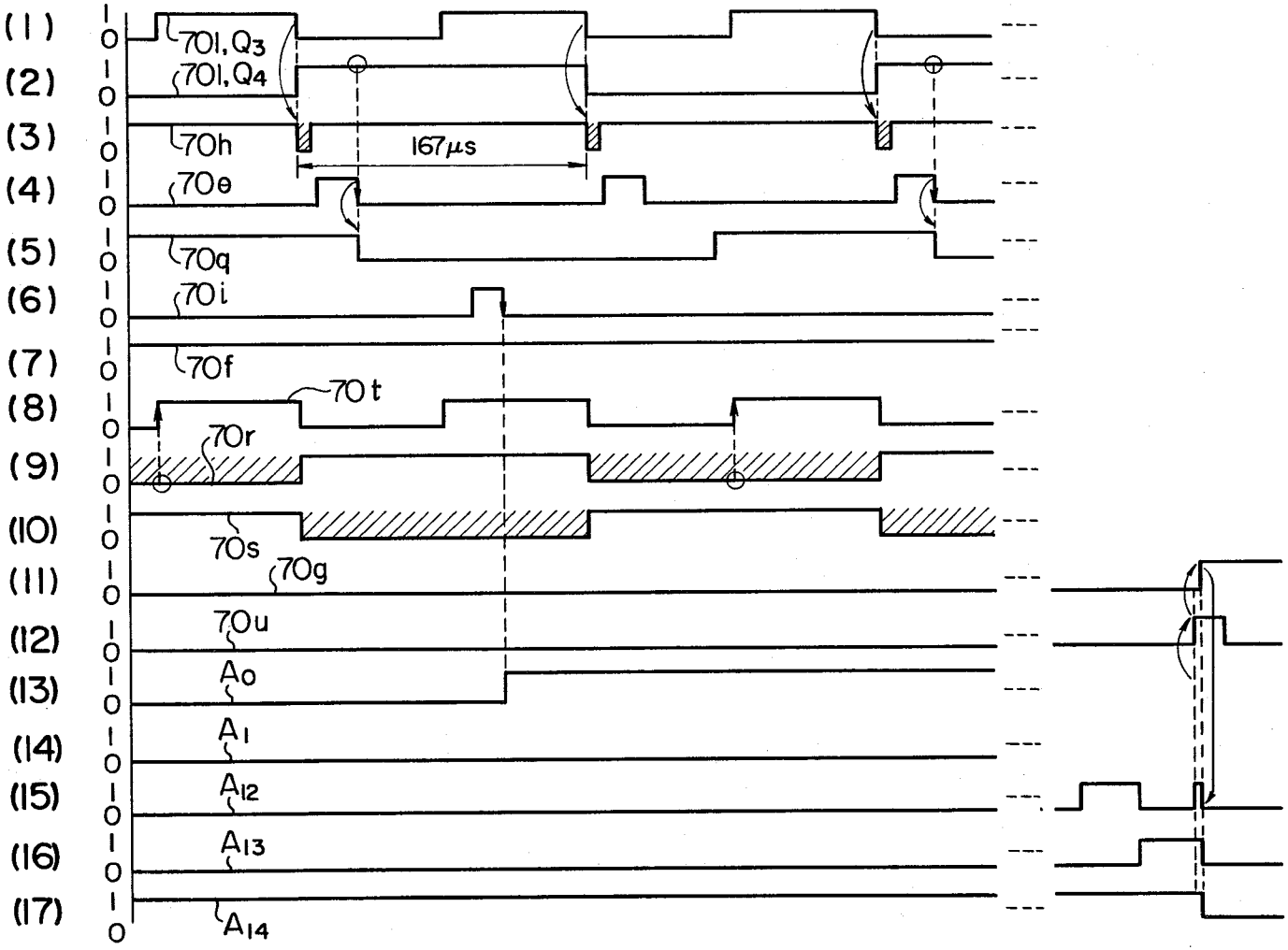

The operation of the apparatus will be described in detail. Timing charts of FIGS. 2 and 3 show the recording and reproduction operations respectively, and the timing chart of FIG. 4 the operation of reproduction and erasure at the time of closing of the key switch 4. The functions of the elements designated by typical symbols including an OR gate, an AND gate and a NAND gate in FIG. 1 will not be partly described.

Assume that the key switch 4 is closed. A pulse signal 70*a* of about 10 ms depending on the time constant due to the capacitor $C_2$ and the resistor $R_2$ is generated by a power-on pulse generator circuit 708 in the mode determining circuit 70B. This pulse signal is applied to flip-flops 702, 703 and 705 (TC4013 of Toshiba), thus resetting these flip-flops. In response to the resetting of the flip-flop 702, a reversed output signal **70*g* thereof becomes "1", thus resetting a counter 701 (TC4024 of Toshiba) of the timing circuit 70A and address counters 706 and 707 (TC4040 of Toshiba) of the memory control circuit 70C**.

If the recording switch R is closed under this condition (the reproducing operation by the closing of the key switch 4 will be described later for convenience' sake), a one-shot multivibrator 710 is triggered, so that a pulse signal **70*m* of about 20 μs is generated as shown in FIG. 2(2). This pulse signal 70*m* is applied to the flip-flops 702 and 705 thereby to reset the same, after which the flip-flop 702 is set by a delay signal 70*n*. In response to the setting of the flip-flop 702, the reversed output signal 70*g* thereof becomes "0" (FIG. 2(4)), so that the reset state of the counters 701 and 706** is cancelled, thus making possible the counting operation.

The pulse signal **70*m*, after being delayed by the time constant circuit (FIG. 2(3)), on the other hand, is applied to the flip-flop 703, which is thus set with the result that the light-emitting diode D is actuated and lit. Thus the user or driver is informed that the recording operation is available. When the user gives a message to the microphone 1, a corresponding voice electrical signal generated from the microphone 1 is amplified and applied to the A/D converter circuit 20**.

In the timing circuit 70, a reference clock circuit 709 continues to generate a clock signal **70*b* of 48 KHz, the counter 701 counts the clock signal pulses 70*b* in response to the cancellation of the resetting of the counter 501, and a frequency-divided signal as shown in FIGS. 2(7) and 2(8)** are produced at the output terminals $Q_3$ and $Q_4$ respectively. The frequency-divided signal $Q_3$ has 6 KHz and the frequency divided signal $Q_4$ has 3 KHz.

The one-shot multivibrator 711 responsive to the fall of the signal from "1" to "0" level generates a pulse signal **70*h* (FIG. 2(5)) taking the level "0" at about 1 μs with the period of 167 μs, in response to the frequency-divided signal $Q_3$ of 6 KHz from the counter 701 and the reset signal 70*g* from the flip-flop 702. This signal 70*h* is applied to the A/D converter 201 as a start pulse for the A/D conversion. The A/D converter circuit 20, which is impressed with the voice signal from the amplifier circuit 10, effects A/D conversion of the voice signal at the sampling frequency of 6 KHz and generates an operating signal 70*θ* which falls from "1" to "0" each time of completion of A/D conversion (FIG. 2(6)**).

In response to this fall of the operating signal **70*θ*, the one-shot multivibrator 712 generates a pulse signal 70*p* of about 1 μs each time of completion of A/D conversion (FIG. 2(9)). This pulse signal 70*p* is applied to a tri-state latch (TC4076 of Toshiba) 713 which performs the latching operation when the signal at the control terminal $G_1$, namely, the frequency-divided signal $Q_4$ of the counter 701 is "0". In other words, in response to odd-numbered pulses 70*p*1, 70*p*3 and so on among the latch pulses 70*p*1, 70*p*2, 70*p*3 and so on shown in FIG. 2(9), the A/D converted digital voice signal is latched. The tri-state gate (TC5012 of Toshiba), on the other hand, gates the A/D converted digital voice signal regardless of the number of times of A/D conversions. In this way, 4-bit digital signals A and B obtained by two A/D conversions are produced from the latch 713 and the gate 714** respectively each time of completion of two A/D conversions.

In response to the fall of the operating signal **70*θ* for A/D conversion and the "1" level of the frequency divided signal $Q_4$ of the counter 701, the one-shot multivibrator 715 produces a timing signal 70*q* of "0" level of about 200 μs (FIG. 2(10)). As long as this timing signal 70*q* is "0", the divider counter 716 is ready to count and counts the clock pulses 70*b* from the reference clock circuit 709 with the result that the divider counter 716 produces pulse signals 70*f*' and 70*i* of "1" level at the timing shown in FIGS. 2(11) and 2(12) respectively at the terminals 2 and 4 thereof (FIG. 2(11) shows a signal 70*f*** that has passed the NAND gate.).

When the count value ($A_0$, $A_1$, $A_2$, . . . $A_{14}$) representing the addresses of the memory unit 60 which is counted by the counters 706 and 707 does not reach a predetermined value (i.e., when the signal **70*j* is "0"), the NAND gate 717 produces a write control signal 70*f* which takes a reversed form of the pulse signal 70*f*' (FIG. 2(11)). At the timing when the reversed signal 70*f* is "0", each of the random access memories 602 of the memory unit 60 is actuated for storage. In view of the fact that the first address is designated at 0 by the resetting of the counters 706 and 707, the voice digital values A and B after the A/D conversion are stored (written) in the first address of the first random access memory group 60A**.

Immediately following each storage, the pulse signal **70*i* (FIG. 2(12)) is applied to the counters 706 and 707 thereby to update the storage addresses ($A_0$ to $A_{14}$). As seen from above, the A/D conversion and the storage of the digital value following the A/D conversion is started by the closing of the recording switch R and repeated in response to the frequency signal of 6 KHz generated at the timing circuit 701 (The storage is effected at the timing of 3 KHz). After a series of A/D conversions, the addresses ($A_0$ to $A_{14}$) designated by the counters 706 and 707** are updated each time of completion of each storage. This process is repeated until the storage addresses are filled up.

Let the sampling frequency after A/D conversion be F, the number of bits thereof be $B_1$ and the capacity of the memory unit 60 be $B_2$ (bits)$\times$W (words). Then the recording time T is given as $T=W\cdot B_2/(F\cdot B_1)$. In the embodiment under consideration, $T=4096\times3\times8/(6\times10^3\times4)\approx4$ sec. Thus the voice continuing for about 4 seconds after the closing of the recording switch R is stored as a digital value.

When the memory addresses are filled up, the count values $A_{12}$ and $A_{13}$ (FIGS. 2(15) and 2(16)) of the counters 706 and 707 both take the level "1", and the recording end signal 701 takes the level "1" at the same time. In response to this "1" signal, the flip-flop 703 of the mode determining circuit 70B is reset. As a result, the display light-emitting diode D is extinguished, thus informing the user of the end of recording. Until another period of about 1.3 seconds pass, the above-mentioned A/D conversions are repeated so that the counts of the counters 706 and 707 increase. For lack of a corresponding address in the memory unit 60, however, no data are stored actually.

At the time point about 5.3 seconds after the closing of the recording switch R, the count value $A_{14}$ (FIG. 2(17)) of the counters 706 and 707 becomes "1", and is recovered as an automatic reproduction signal **70*j*. This signal is reversed and applied to one of the input terminals of the NAND gate 717**. Thus, the write control signal 70*f* derived from the output thereof remains "1" regardless of the pulse signal 70*f*. Each random access memory 602 making up the memory unit 60 transfers to a read mode and therefore fails to perform a storage operation.

The recording processes are thus completed. Even when the key switch 4 is opened after the completion of the recording operation, the voltage of the memory unit 60 is maintained by the voltage regulator 802 and therefore the recorded voice is held. When the voltage drop detector circuit 718 detects that the key switch 4 is open or when the apparatus is standing by (or when the flip-flop 702 is reset), the signal 70*e* is raised to "1" level via the OR gate 719, immediately followed by deactivation of the memory unit 60.

In the embodiment under consideration, the reproduction is automatically effected after recording to confirm the recording. The reproduction operation will be described. Following the recording operation mentioned above, the automatic reproduction signal 70*j* is "1", and therefore the write control signal 70*f* takes a level "1", thus prohibiting another recording. And the tri-state latch 713 and the tri-state gate 714 stop the latching and gating operations, whereas the latch and gating operation of the tri-state latch 720 and the tri-state gate 721 respectively are made possible.

In other words, the counter 701 still continues to divide the frequency of the clock signal 70*b* and therefore both the operation of A/D conversion and the generation of the address counting pulse signal 70*i* in the memory control circuit 70C are repeated (FIGS. 3(1) to 3(6)). In this case, the converting operation of the converter circuit 20 is meaningless, and this converter circuit 20 is used for determining the timing of generating at intervals of 3 KHz the address count pulses 70*i* (FIG. 3(6) for updating the addresses of the memory unit 60. The frequency-divided signals $Q_3$ and $Q_4$ (FIGS. 3(1) and 3(2) of the counter are partly reversed with the same phase and applied to the tri-state latch 720 and the tri-state gate 721 as control signals 70*t*, 70*r* and 70*s* thereof (FIGS. 3(8), 3(9) and 3(10)).

In view of the fact that the tri-state latch 720 and the tri-state gate 721 are impressed with memory data (voice digital data) updated and produced at intervals of 3 KHz in the 8-bit input-output signal line of the memory unit 60, low significant voice digital data A and high significant voice digital data B are applied 4 bits at a time from the tri-state gate 721 and the tri-state latch 720 in that order to the D/A converter circuit 30. Thus the D/A converter 301 accomplishes the D/A converting operation at the same timing as the A/D conversion of the A/D converter 201, thus producing a voice signal as a voltage value.

The sampling noise of this voice signal is cut by the low-pass filter 40, and the particular signal is amplified by the amplifier circuit 50, followed by the reproduction through the speaker 2.

After completion of reproduction, when the memory addresses are filled up and all the count values of $A_{12}$, $A_{13}$ and $A_{14}$ take "1", the reproduction end signal 70*k* takes "1" and is applied to the one-shot multivibrator 22 of the mode determining circuit 70B. In response to this, the one-shot multivibrator 722 produces a pulse signal 70*u* of about 20 μs and resets the flip-flops 702 and 705. By the resetting of the flip-flop 702, the counters 701, 706 and 707 are reset, thus providing a stand-by state. In this way, reproduction is automatically effected and confirmed by the user after recording.

Subsequently, it is also possible to reproduce the stored data when desired. Specifically, when the confirmation switch P is closed, the flip-flops 702 and 705 are set. By the setting of the flip-flop 702, the reset state of the counters 701, 706 and 707 is cancelled. By the setting of the flip-flop 705, on the other hand, the write control signal 70*f* is maintained at "1" (namely, fixed at the read mode). As in the case of reproduction mentioned above, the counting operation of the counter 701 updates the stored count values of the counters 706 and 707, in synchronism with which the latch 720 and the gate 721 are activated. As a result, the stored data are sequentially read out, and through D/A conversion, noise cut and amplification processes, are reproduced from the speaker 2. In this case, the reproduction is effected until all the count values $A_{12}$, $A_{13}$ and $A_{14}$ take "1", that is, only twice. And the stand-by state is again restored at the timing when the reproduction end signal 70*k* takes "1".

As described above, the memory unit 60 is supplied with power regardless of the operating state of the key switch 4, and therefore the stored data are maintained even after the key switch 4 is opened.

Figure 4:
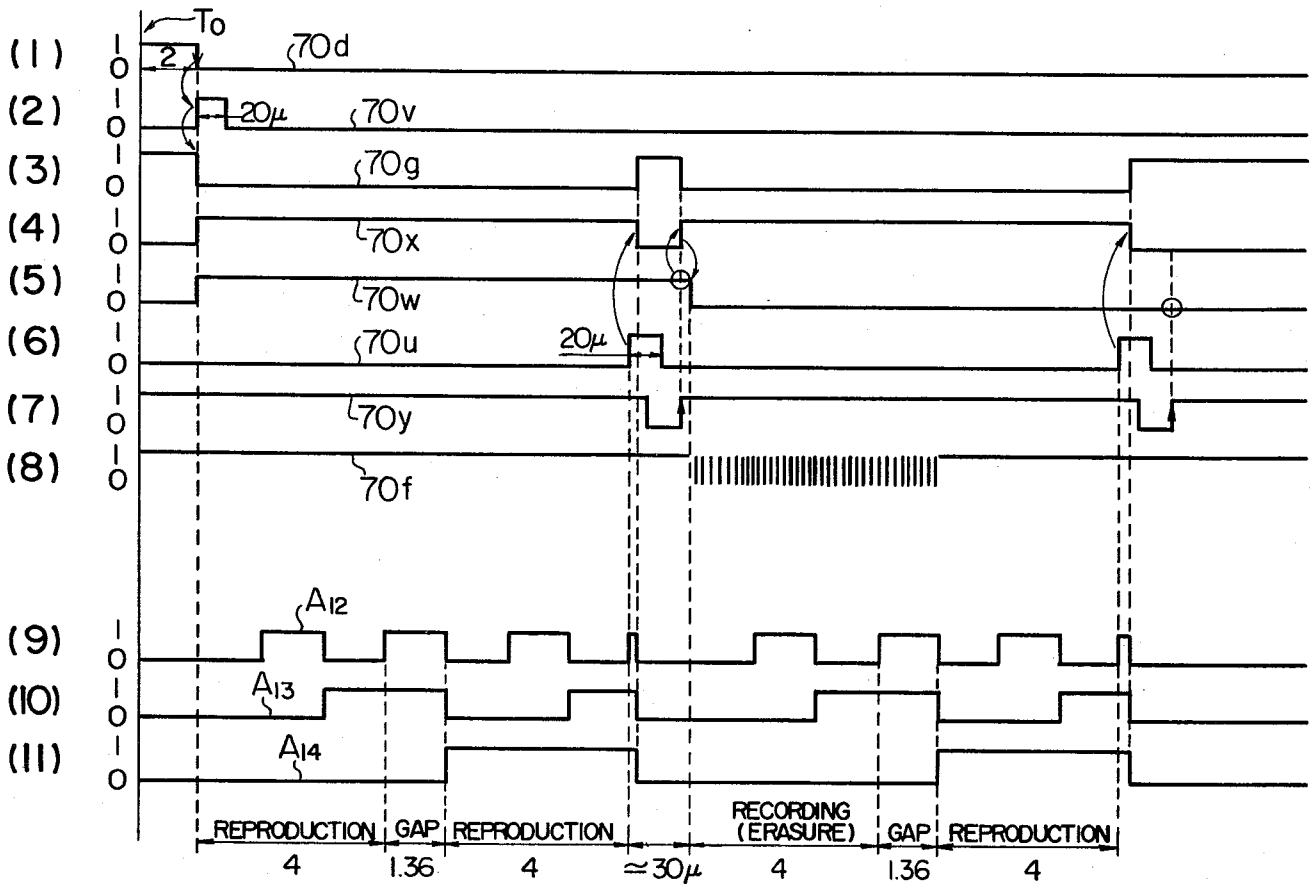

When the same user or another user closes the key switch 4 after the opening thereof, the reproduction of the data thus kept stored is automatically started. This operation is shown in FIG. 4.

Assuming that the key switch 4 is closed again, the voltage regulator 801 generates a predetermined voltage, so that a sensor circuit 724 including a time constant circuit due to the capacitor $C_1$ and $R_1$ produces a "1" level detection signal 70*d* of about 2 s. (FIG. 4(1)) In response to the fall of the detection signal 70*d*, the one-shot multivibrator 725 produces a pulse signal of about 20 μs (FIG. 4(2)), thus setting the flip-flops 702, 704 and 705. (The time constant due to the capacitor $C_2$ and the resistor $R_2$ of the power-on pulse generator circuit 708 is smaller than that due to the capacitor $C_1$ and the resistor $R_1$). By the setting of the flip-flops 702 and 705, the reproduction is effected twice as in the case of the closing of the confirmation switch P as described above.

In this way, the new user is informed of the voice data stored by the preceding user in the memory unit as a message.

After repetition of two announcements of the message, the reproduction end signal 70*k* is applied to the one-shot multivibrator 722 as mentioned above, and this one-shot multivibrator 722 resets the flip-flops 702 and 705. In view of the fact that the flip-flop 704 is still set (FIG. 4(5)), however, the flip-flop 702 alone is set again. In other words, the A/D conversion and storage are effected as in the case where the recording switch R is closed. No voice is supplied from the microphone 1, and therefore the voice digital value stored already in the memory unit 60 is substantially erased. The flip-flop 704 commanding the recording (erasure) is reset by the signal 70*x* generated at the time of another setting of the flip-flop 702, and therefore only one recording (erasure) is effected. And after another reproduction, the apparatus enters a stand-by state.

As explained above, after the key switch 4 is closed, the message is reproduced and announced twice, and then automatically erased.

In the foregoing described embodiments, the message is automatically erased after reproduction. As an alternative, if the flip-flop 704 is eliminated, the message may be repeated after the closing of the key switch.

Means responsive to the start of operation of the motor vehicle may include a switch responsive to the seating of the driver or a door open switch instead of the key switch 4 and the sensor switch 724.

Further, in place of the memory unit used in the above-mentioned embodiments, a memory unit such as a magnetic disc, a magnetic drum or a magnetic tape or a non-volatile semiconductor memory unit which does not require any back-up of a power supply may be used. Such a magnetic tape, drum or disc is capable of storing the voice signal as an analog signal.

It will be understood from the foregoing description that according to the present invention a voice message is capable of being transmitted from a user to the next user through the stationary condition of the vehicle involved.

We claim:

1. A vehicle-mounted message apparatus comprising a recording switch; a converter enabled responsive to an actuation of said switch for converting an applied voice message into an electrical signal; memory means for recording and holding data corresponding to said electrical signal; sensor means for sensing a vehicle starting condition and generating a start signal; and reproduction means responsive to the start signal for reading out the data held in the memory means to convert to an output voice; whereby an optional message recorded by a prior driver can be communicated to a present driver in voice form when the present driver is ready to drive.

2. A vehicle-mounted voice message apparatus comprising a record command switch, a reproduction command switch; converter means for converting an applied voice message into a corresponding electrical signal; memory means for for writing therein data corresponding to said electrical signal; means for sensing a vehicle starting condition to generate a start signal; control means for controlling operations of writing in and reading out data of said memory means in response to actuations of the switches and in response to absence or presence of the start signal; reproduction means for converting the read-out data to an output voice; said control means including means for reading out data of the memory means and enabling the reproduction means for identification of the data soon after storing operation of the memory means, whereby an optimum voice message recorded by a prior driver is communicated to a present driver in voice form when the present driver is ready to drive.

3. A vehicle-mounted voice message apparatus in accordance with claim 2 wherein said control means includes a timing circuit, a mode determining circuit and a control circuit, said timing circuit including storage means for storing said data in said memory means and read-out means for reading out said stored data, said mode determining circuit determining a selected one of the modes of recording, reproduction and erasure, and said control circuit specifying a selected one of the storing and reading operations and designating a memory address.

4. An apparatus according to claim 3, further comprising an analog/digital converter circuit for converting said electrical signal into a digital electrical signal for storage in said memory means, a digital/analog converter circuit for converting the digital electrical signal read out of said memory means into an analog electrical signal for reproducing a voice, and said mode determining circuit including first circuit means for generating a signal for enabling said timing circuit in response to the turning on of said recording commanding switch.

5. An apparatus according to claim 4, in which said timing circuit includes a circuit for generating a reference clock signal, a frequency divider circuit for frequency-dividing said clock signal and producing a first frequency signal and a second frequency signal, and storage means having second circuit means for gating and latching in response to said second frequency signal the output of said analog/digital converter circuit actuated in response to said first frequency signal; and said control circuit includes a counter circuit for designating a writing address in response to said second frequency signal and the converting operation of said analog/digital converter circuit.

6. An apparatus according to claim 5, further comprising a third circuit means for disabling said second circuit means in response to an automatic reproduction command signal representing the full count of said counter circuit, and fourth circuit means for gating and latching the data stored in said memory means in response to said automatic reproduction command signal and the counting operation of said counter circuit operated in response to said second frequency signal.

7. An apparatus according to claim 5 or 6, wherein said mode determining circuit includes fifth circuit means for resetting said frequency divider circuit and said counter circuit thereby to cause them to enter a stand-by mode in response to the reproduction end count of said counter circuit.

8. An apparatus according to claim 3, 4, 5 or 6, wherein said mode determining circuit includes means for activating said timing circuit in response to the turning on of said reproduction command switch and means for causing the reproduction operation in response to said turning on of said reproduction command switch.

9. An apparatus according to claim 3, 4, 5 or 6, wherein said mode determining circuit includes means for activating said timing circuit by detecting the turning on of said key switch, means for starting the reproduction operation for confirmation of the stored data in response to said turning on of said key switch, and means for causing the erasing operation after said reproduction.

10. An apparatus according to claim 3, 4, 5 or 6, wherein said power supply includes a voltage regulator for generating a constant voltage in response to said turning on of said key switch, a voltage regulator for generating a constant voltage all the time regardless of the actuation of said switches for backing up said memory means, and a DC-DC converter for generating a voltage for actuating said converters.

11. An apparatus according to claim 1 or 3, wherein said memory means is an analog memory.

12. An apparatus according to claim 1 or 3, wherein said memory means is a digital memory.

13. An apparatus according to claim 1, further comprising an analog-digital converter for converting said electrical signal into a digital electrical signal for storage in said memory means, and an digital/analog converter circuit for converting a digital electrical signal read out of said memory means into an analog electrical signal for reproducing the voice.

14. An apparatus according to claim 3, further comprising an analog-digital converter for converting said electrical signal into a digital electrical signal for storage in said memory means, and a digital/analog converter circuit for converting a digital electrical signal read out of said memory means into an analog electrical signal for reproducing the voice.

* * * * *